US007236134B2

(12) United States Patent
Licul et al.

(10) Patent No.: US 7,236,134 B2
(45) Date of Patent: Jun. 26, 2007

(54) PROXIMITY-COUPLED FOLDED-J ANTENNA

(75) Inventors: Stanislav Licul, Plantation, FL (US); Pha C. Nguyen, Lake Worth, FL (US); Lorenzo A. Ponce De Leon, Lake Worth, FL (US)

(73) Assignee: Motorola, Inc., Schaumburg, IL (US)

( * ) Notice: Subject to any disclaimer, the term of this patent is extended or adjusted under 35 U.S.C. 154(b) by 59 days.

(21) Appl. No.: 11/273,973

(22) Filed: Nov. 14, 2005

(65) Prior Publication Data

US 2007/0109201 A1 May 17, 2007

(51) Int. Cl.
*H01Q 1/24* (2006.01)

(52) U.S. Cl. ..... 343/702; 343/700 MS

(58) Field of Classification Search ..... 343/700 MS, 343/702, 829, 846
See application file for complete search history.

(56) References Cited

U.S. PATENT DOCUMENTS 4,628,322 A * 12/1986 Marko et al. ..... 343/702
6,759,990 B2 * 7/2004 Rossman ..... 343/700 MS
6,943,730 B2 * 9/2005 Poilasne et al. ..... 343/700 MS
6,956,530 B2 * 10/2005 Kadambi et al. ..... 343/702
7,072,690 B2 * 7/2006 Shin et al. ..... 455/557
7,084,813 B2 * 8/2006 Pathak et al. ..... 343/700 MS

FOREIGN PATENT DOCUMENTS

WO WO 2004/025778 3/2004

* cited by examiner

*Primary Examiner*—Tho Phan

(57) ABSTRACT

A Proximity Coupled-Folded-J Antenna PC-FJA (104) includes a ground plane (240), first resonant element (352) with a "J" shape that resonates at a first radio frequency, a second resonant element (350) positioned within the "J" shape and that resonates at a second radio frequency, and a third resonant element (118) with a portion that is substantially parallel to and removed from the plane of the "J" shape and that resonates at a third radio frequency. The PC-FJA (104) has a fourth resonant element (130) with a loop (132) in a plane perpendicular to and removed from the plane of the "J" shape. The fourth resonant element (130) resonates at a fourth radio frequency. These elements are ohmically coupled to a connection arm (108). The ground plane (240) is removed from PC-FJA (104) and is perpendicular to the plane of the "J" shape.

20 Claims, 6 Drawing Sheets

300

400

600

PROXIMITY-COUPLED FOLDED-J ANTENNA

FIELD OF THE INVENTION

The present invention generally relates to the field of radio frequency antennas and more particularly to radio frequency antennas that efficiently radiate in multiple radio frequency bands.

BACKGROUND OF THE INVENTION

Small, portable wireless communications devices, such as cellular telephone, PDAs and the like, face increasing challenges associated with the design of effective wireless communications antennas. Internal antennas are able to be embedded in cases that have an appealing form factor and are often used in wireless communications devices. Internal antennas, however, are generally limited in their radio frequency coverage and in their ability to provide efficient radiation in many radio frequency bands. These limitations present a design difficulty for wireless communications devices that are required to communicate in several radio frequency bands, particularly if a small form factor is desired. For example, a wireless communications device may be required to perform cellular communications in RF bands in the vicinity of 800 MHz, 900 MHz, 1800 MHz and 1900 MHz and to also support data communications in the 2400 MHz band, which is used for communications using Bluetooth® and the IEEE 802.11b/g standard. These devices may also be required to support data communications in the 5200 MHz band used for communications using the IEEE 802.11a standard. The requirement to perform radio communications in these six bands generally requires that multiple, small form factor internal antennas be used in such a wireless communications device. The use of multiple internal antennas adversely increases design complexity, costs, and size requirements.

Therefore a need exists to overcome the problems with the prior art as discussed above.

SUMMARY OF THE INVENTION

According to a preferred embodiment of the present invention, an antenna has a ground plane and a first resonant element that resonates at a first frequency. The first resonant element forms a substantially "J" shape that defines an element plane substantially perpendicular to and removed from the ground plane. The antenna further has a second resonant element that electrically resonates at a second frequency that is higher than the first frequency. The second resonant element includes at least a second resonant element first section that is positioned within the "J" shape. The antenna also has a third resonant element that has a length less than the first resonant element and less than the second resonant element. The third resonant element is positioned at a low impedance point of the first resonant element and is configured to electrically resonate at a third frequency. The third resonant element further has at least a portion that is substantially parallel to and removed from the element plane and that is removed from the ground plane. The antenna also has a fourth resonant element that resonates at a fourth frequency. The fourth resonant element includes a loop defining a second plane that is perpendicular to the element plane. The loop of the fourth resonant element is removed from the element plane and the ground plane, and is positioned at a low impedance point of the first resonant element.

The antenna further has an element connection arm that is ohmically coupled to the first resonant element, the second resonant element, the third resonant element and the fourth resonant element.

According to another aspect of the present invention, a method includes providing a ground plane and providing a first resonant element that forms a "J" shape and that electrically resonates at a first frequency. The first resonant element defines an element plane that is substantially perpendicular to and removed from the ground plane. The method further includes providing a second resonant element that is configured to electrically resonate at a second frequency that is higher than the first frequency. The second resonant element includes at least a second resonant element first section that is positioned within the "J" shape. The method also includes providing a third resonant element with at least a portion substantially parallel to and removed from the element plane. The third resonant element is removed from the ground plane and has a length less than the first resonant element and less than the second resonant element. The third resonant element is also positioned at a low impedance point of the first resonant element and configured to electrically resonate at a third frequency. The method further includes providing a fourth resonant element that has a loop with at least a part of the fourth resonant element defining a second plane perpendicular to the element plane and removed from the ground plane. The positioning of the fourth resonant element includes positioning the loop so as to be removed from the element plane. The fourth resonant element is positioned at a low impedance point of the first resonant element and is configured to electrically resonate at a fourth frequency. The method also includes ohmically coupling the first resonant element, the second resonant element, the third resonant element and the fourth resonant element to an element connection arm.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

DETAILED DESCRIPTION

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting but rather to provide an understandable description of the invention.

The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language).

Figure 1:
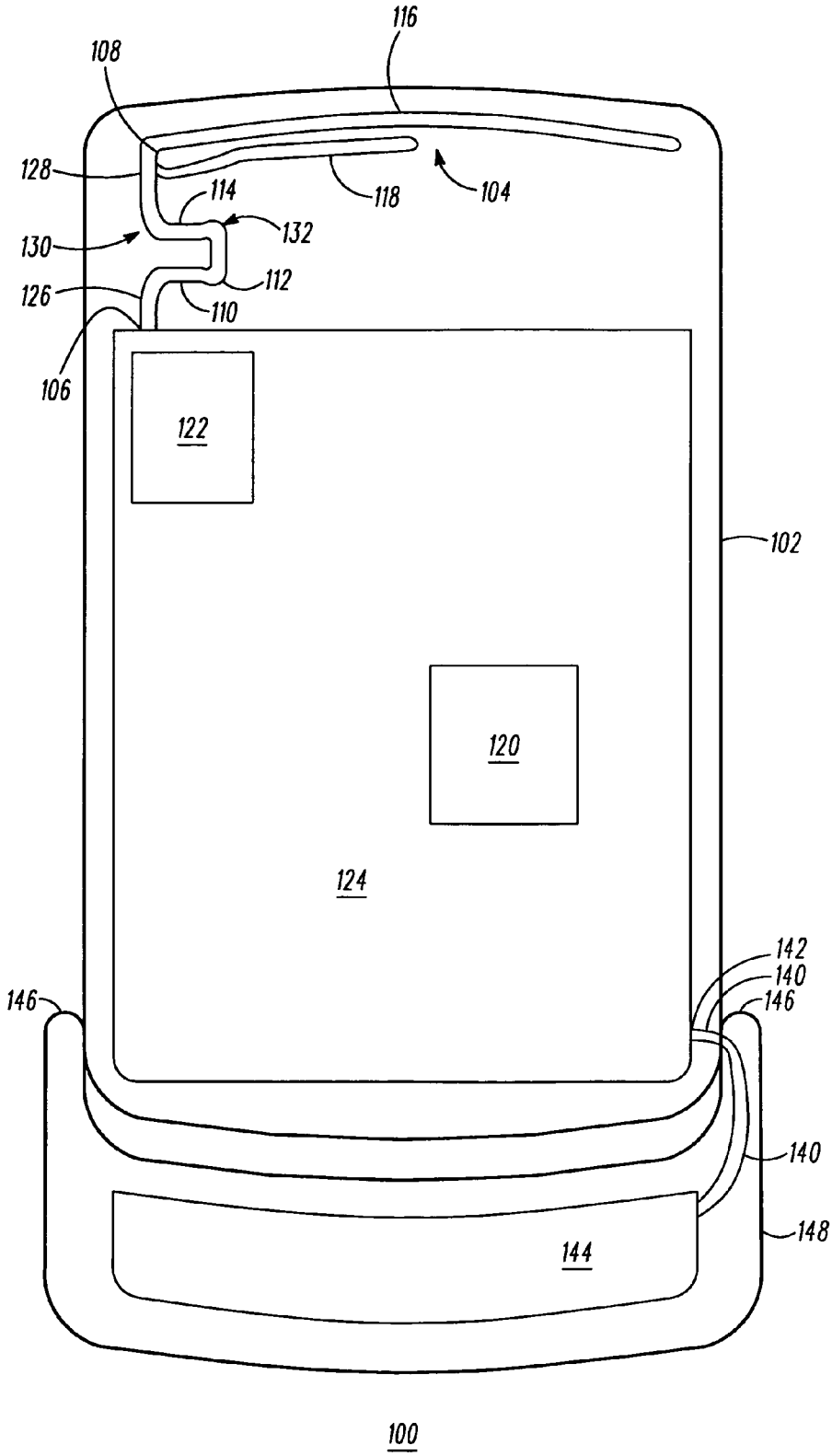
FIG. 1 illustrates a cellular telephone incorporating a Proximity Coupled Folded-J Antenna (referred to as "PC-FJA" herein), according to an exemplary embodiment of the present invention.

FIG. 1 illustrates a cellular telephone 100 incorporating a Proximity Coupled Folded-J Antenna 104 (referred to as "PC-FJA" herein), according to an exemplary embodiment of the present invention. The exemplary cellular phone 100 includes a case 102 and an electronic circuit board 124.

The cellular telephone 100 has a PC-FJA 104 that is coupled to circuits on the electronic circuit board 124 at a feed-point 106. This illustration shows the electronic circuits side of the electronic circuit board 124. The reverse side of the electronic circuit board 124 has a circuit board ground plane, as is described below. The exemplary cellular phone 100 includes a flip portion 148 that is rotatably attached to case 102 by hinges 146. The flip portion 148 of the exemplary embodiment includes a second ground plane 144 that is attached to a ground circuit at a ground connection 142 of the electronic circuit board 124 via a ground cable 140. Ground cable 140 includes components designed to provide a proper ground coupling through the hinge 146. The flip portion 148 of further embodiments is able to include electronic circuits and user interface components, such as speakers, microphones and/or graphical displays. The flip portion 148 is able to operate when placed in an extended position, as is illustrated in FIG. 1, or when placed in a folded position so as to be located adjacent to case 102, as is described below. The extended position of the flip portion 148 of various embodiments is able to place the second ground plane 144 in either a plane that is parallel to the plane of the circuit board ground plane that is part of the electronic circuit board 124 or in a plane that forms an angle with the plane of the electronic circuit board 124. The second ground plane 144 of the exemplary embodiment forms a ground plane that operates with and electromagnetically couples with the PC-FJA 104.

The PC-FJA 104 has an element plane 116 that includes several antenna elements, as is described below. The element plane 116 of the exemplary embodiment is perpendicular to and removed from the circuit board ground plane that is part of the electronic circuit board 124, as is described below. The PC-FJA 104 has a stubby element 130 that is a meander-line structure that ohmically couples the feed-point 106 to an element connection arm 108, which is a conductor within the element plane 116. The element connection arm 108 is perpendicular to the plane of the view depicted in FIG. 1. The stubby element 130 includes a first connecting arm 126, a second connecting arm 128 and a short loop 132. The short loop 132 is formed by a loop lower segment 110, a loop upper segment 114 and a loop connecting segment 112. The loop lower segment 110, the loop upper segment 114 and the loop connecting segment 112 of the exemplary embodiment are substantially straight. The loop lower segment 110 and the loop upper segment 114 of the exemplary embodiment are also arranged to be substantially parallel and reactively coupled. Further, the loop lower segment 110 and the loop upper segment 114 are substantially aligned since they each have one of their ends aligned with the loop connecting segment 112. The short loop 132 has one end ohmically coupled to the element connection arm by the second connecting arm 128 and the other end of the short loop 132 is ohmically coupled to the connection point 106 through the first connecting arm 126. The third resonance arm 118 of the exemplary embodiment is removed, i.e., is not within, the element plane 116 and is located between the element plane 116 and the feed-point 106. The elements of the PC-FJA 104 and their operation and interactions are described in detail below.

The exemplary cellular phone 100 further includes RF circuits 122 that include RF receiving circuits, including a receiver, that receive signals from the antenna and recovers baseband signals therefrom. The RF circuits 122 of the exemplary embodiment further include RF transmitting circuits, including a transmitter, that modulate and mix baseband signals and up-convert those baseband signals to RF signals that are transmitted via the PC-FJA 104. The RF circuits 122 allow simultaneous transmission and reception. RF circuits 122 also include impedance matching circuits to improve coupling of RF energy between the RF circuits 122 and the PC-FJA 104 of the exemplary cellular phone 100, as is understood by those of ordinary skill in the relevant arts in view of the present disclosure. The RF circuits 122 of the exemplary embodiment are ohmically coupled to a conductor within the element plane 116 through stubby element 130.

The RF circuits 122 of the exemplary embodiment are able to operate within six defined radio frequency bands. The RF circuits 122 perform cellular telephone communications in RF bands in the vicinity of 800 MHz, 900 MHz, 1800 MHz and 1900 MHz. The RF circuits further provide bi-directional data communications in the Bluetooth band, the 2400 MHz band used for communications using the IEEE 802.11b/g standard and the 5200 MHz band used for communications using the IEEE 802.11a standard. The PC-FJA 104 advantageously operates efficiently in all six of these defined radio frequency bands with a space efficient physical design, thereby providing space savings, weight reduction and design simplification by obviating the need for multiple antennas to support operation in all six of these bands. The RF circuits 122 and PC-FJA 104 form a wireless communications section of a wireless communications device in this exemplary embodiment.

The exemplary cellular phone 100 further includes a baseband circuit 120 that processes data, audio, image, and video data, as communicated with a user interface circuit, such as speakers, display, cameras, keypads, buttons, touchpads, joysticks, and other interface circuits (all not shown), in a manner well known to those of ordinary skill in the art in order to interface this information with the RF circuits 122. Other electronic circuits within the wireless device 100 are included, such as a controller, memory storage, communications interfaces, audio signal conditioning circuits, data signal conditioning circuits, as is well known to those of ordinary skill in the relevant arts, but are not shown in order to enhance the clarity and understandability of this diagram.

The exemplary cellular phone 100 has a case 102 that is a housing and support structure for this exemplary embodiment. Electronic device housings, such as case 102, are able to be constructed in a variety of shapes and include a number of various human-machine interface features, such as keypads, displays, and so forth.

Design techniques known to practitioners of ordinary skill in the relevant arts, including utilization of computer simulation software to model the electro-magnetic characteristics of antenna structures, are able to design such antenna structures to conform to a wide variety of case outlines and shapes.

Figure 2:
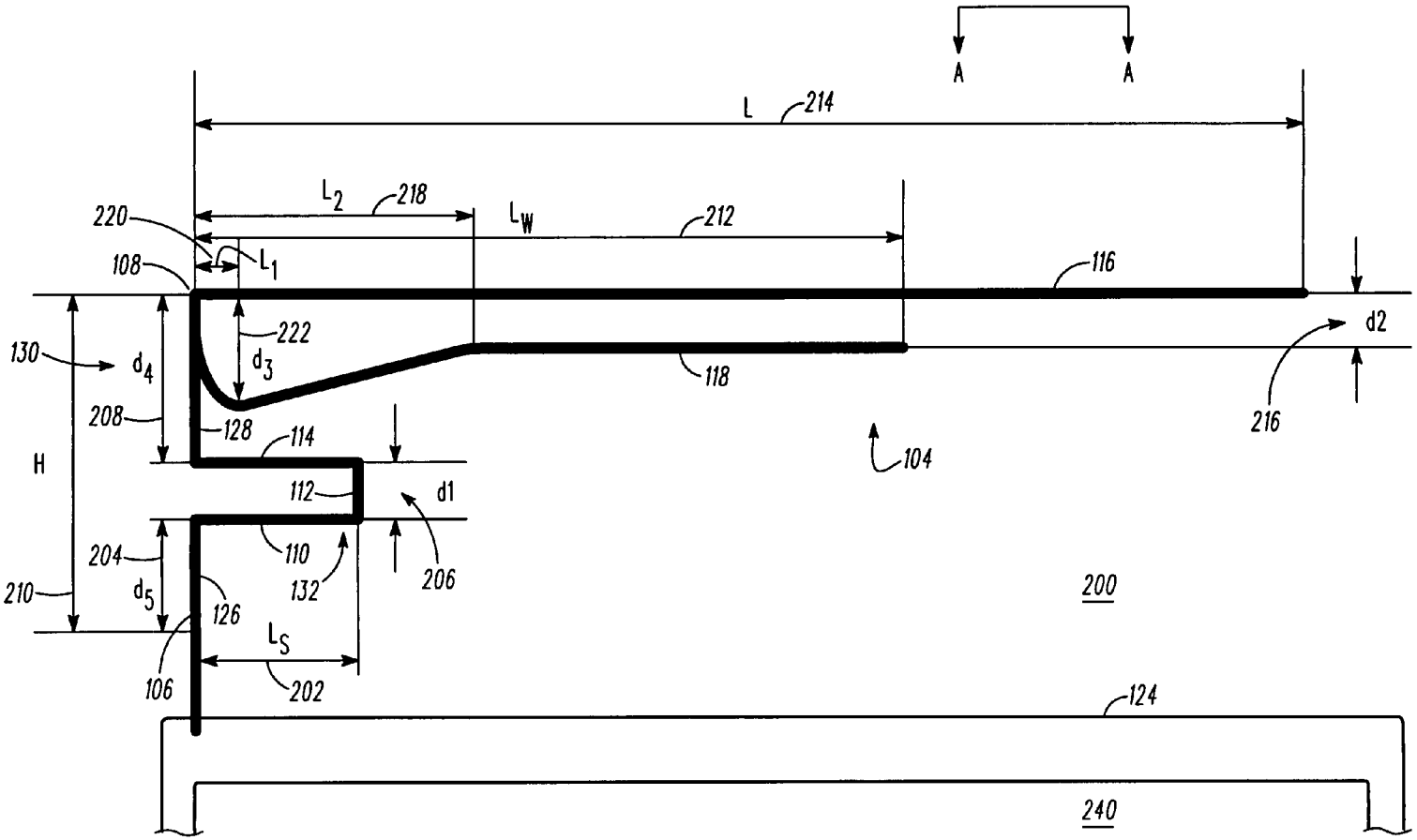
FIG. 2 illustrates a PC-FJA side view, according to an exemplary embodiment of the present invention.

FIG. 2 illustrates a PC-FJA side view 200, according to an exemplary embodiment of the present invention. The PC-FJA side view 200 is a similar view of the PC-FJA 104 as illustrated for the exemplary cellular phone 100 described above. The PC-FJA side view 200 depicts the circuit board ground plane 240 that is located beneath the electronic circuit board 124. As illustrated, the circuit board ground plane 240 is a grounded, conductive surface that is in proximity to but removed from the PC-FJA 104. The circuit board ground plane 240 forms a plane that is perpendicular to, but removed from, the element plane 116 of the PC-FJA 104. Further, the circuit board ground plane 240 is removed from the short loop 132 and the stubby element 130 the PC-FJA 104 so that no ground plane conductor overlaps with elements of the PC-FJA 104. The circuit board ground plane 240 of the exemplary embodiment forms a ground plane that operates with and electromagnetically couples with the PC-FJA 104. The PC-FJA 104 operates and couples with ground planes formed by the circuit board ground plane 240 and the second ground plane 144 in order to form an efficient, multi-band RF receiving and transmitting antenna structure.

As discussed above, the PC-FJA 104 includes a stubby element 130. Stubby element 130 includes a first connecting arm 126 that has a coupling at the feed-point 106 and extends to the loop lower segment 110. The first connecting arm 126 of the exemplary embodiment has a fifth dimension $d_5$ 204 of 2 mm. A short loop 132 is formed by the loop lower segment 110, the loop upper segment 114 and the loop connecting segment 112. In the exemplary embodiment, the loop lower segment 110 and the loop upper segment 114 each have a length $L_s$ 202 of 12 mm. The loop connecting segment 112 of the exemplary embodiment has a length $d_1$ 206 of 1.0 mm. The short loop 132 is ohmically coupled to a conductor within the element plane 116 at an element connection arm 108 by the second connecting arm 128. The second connecting arm 126 of the exemplary embodiment has a length $d_4$ 208 of 2.5 mm. The overall height of the stubby element 130 is H 210, which is 11 mm in the exemplary embodiment. The element plane 116 includes several elements that are described in detail below.

The PC-FJA side view 200 further illustrates the third resonance arm 118 that is removed from the element plane 116 and is located between the element plane 116 and the short loop 132 in the exemplary embodiment of the present invention. The third resonance arm 118 couples to a conductor within the element plane and forms a radiator that couples with other elements of the PC-FJA 104. The third resonance arm 118 of the exemplary embodiment has a resonance in the vicinity of 2400 MHz. Alternate embodiments of the present invention tune the third resonance arm 118 to have a resonance in the vicinity of the 2100 MHz band. The third resonance arm 118 of the exemplary embodiment has an overall length $L_w$ 212 of 24 mm. The third resonance arm 118 couples to the element connection arm 108 and forms a bulge by beginning to extend away from the element plane 116. The third resonance arm 118 of the exemplary embodiment has a maximum distance from the element plane equal to dimension $d_3$ 222, which is 2 mm. This distance is reached at a distance $L_1$ 220 along the element plane from the element connection arm 108, which is 3 mm in the exemplary embodiment. The third resonance arm 118 then completes the bulge by returning at an angle towards the element plane 116. The third resonance arm 118 returns to a distance of $d_2$ 216 from the element plane 116 at a distance of $L_2$ 218 from the element connection arm 108 along the element plane 116, which is 11 mm in the exemplary embodiment. The distance $d_2$ 216 is 0.5 mm in the exemplary embodiment. The third resonance element 118 then extends parallel to the element plane 116 and removed from the element plane by a distance $d_2$ 216 for the length along the element plane 116 beginning at a distance of $L_2$ 218 from the element connection arm 108 through a distance of $L_w$ 212 from the element connection arm 108. The above example tunes the third resonance arm to have a resonance in the vicinity of 2400 MHz. Alternate embodiments of the present invention tune the third resonance arm 118 to have a resonance in the vicinity of the 2100 MHz band.

Figure 3:
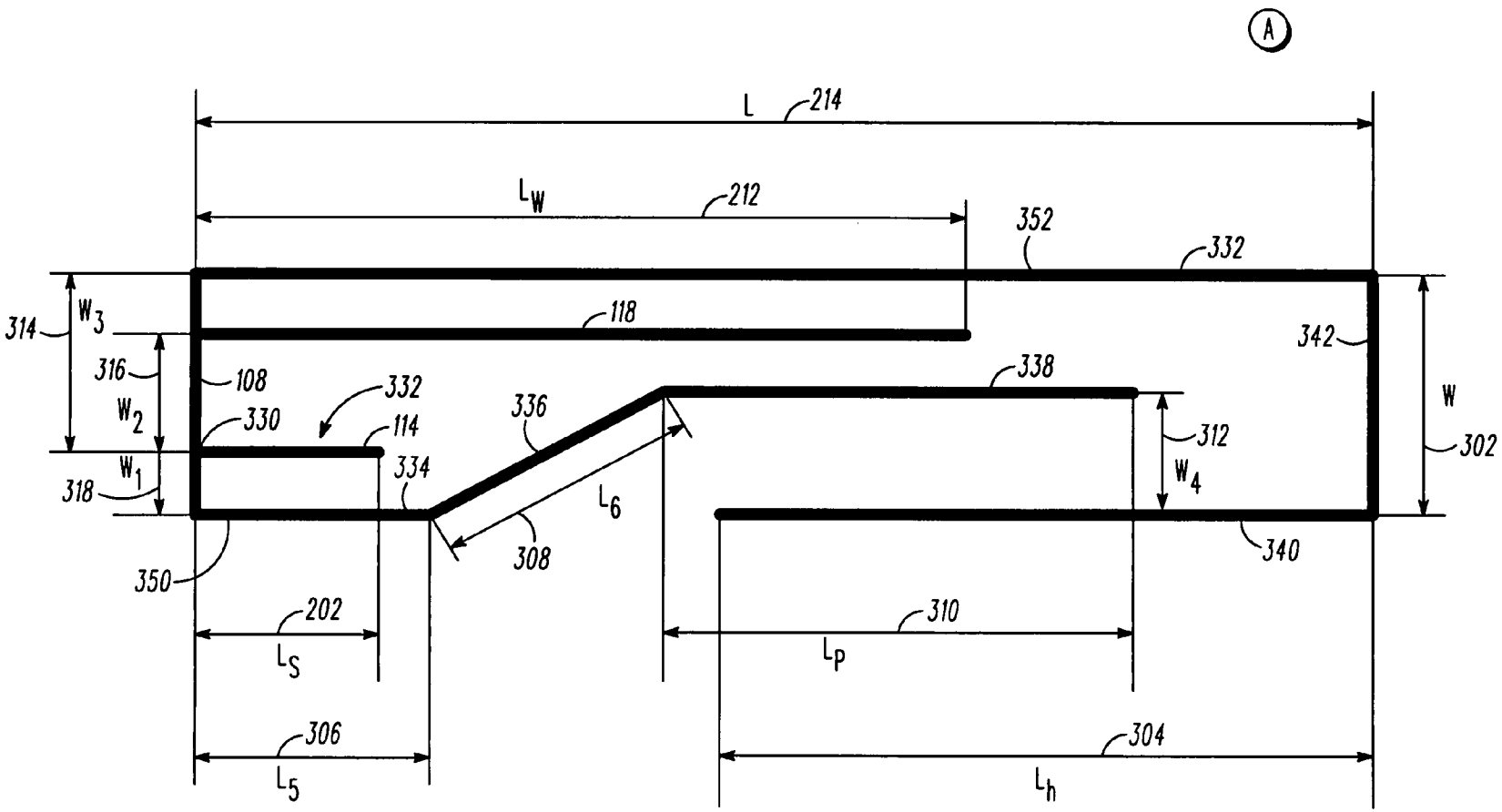
FIG. 3 illustrates PC-FJA top view, according to an exemplary embodiment of the present invention.

FIG. 3 illustrates PC-FJA top view 300, according to an exemplary embodiment of the present invention. The PC-FJA top view 300 is a perpendicular view from the top of aspect of FIG. 2. The PC-FJA top view 300 shows the element connection arm 108 that has ohmic coupling to other elements of the PC-FJA 104. The element connection arm 108 has a total length W 302, which is 9 mm for the exemplary embodiment.

The stubby element 132 ohmically couples to the element connection arm 108 at the stubby element connection point 330. The PC-FJA top view 300 illustrates the upper arm 114, which is removed from the element plane 116 as is described for the PC-FJA side view 200.

The third resonance element 118 also ohmically couples to the element connection arm 108 at a location that is at a distance of $w_2$ 316 above the stubby element connection point 330. The $w_2$ 316 distance is 2 mm in the exemplary embodiment. As discussed above with reference to the PC-FJA side view 200, the third resonance element 118 is removed from the element plane 116.

A first resonant element 352 of the exemplary embodiment includes a first resonant element first section 332, a first resonant element second section 342 and a first resonant element third section 340. The first resonant element 352 forms a "J" shape and lies in the element plane 116. Although the element plane 116 is illustrated as a flat plane to facilitate understanding of the description in this specification, it is to be understood that the element plane 116 of the exemplary embodiment, and of some further embodiments of the present invention, is a curved plane that is not flat. It is to be further understood that the element plane 116 is able to be a flat plane or a plane that is curved along one or two dimensions. It is to be understood that further embodiments of the present invention have elements that lie outside of a common plane, even though those elements may correspond to elements of the PC-FJA 104 of the exemplary embodiment that are shown lie in the element plane 116.

The first resonant element first section 332 of the first resonant element 352 ohmically couples to the element connection arm 108 at a distance that is $w_3$ 314 above the stubby element connection point 330. The $w_3$ 314 dimension is 0.3 mm in the exemplary embodiment. The first resonant element first section 332 has a length of L 214, which is 39 mm in the exemplary embodiment. The opposite end of the first resonant element first section 332 ohmically couples to the first resonant element second section 342. The first resonant element second section 342 is substantially perpendicular to the first resonant element first section 332 and substantially parallel to the element connection arm 108. The first resonant element second section 342 has a length of W 302, which is 9 mm in the exemplary embodiment. The other end of the first resonant element second section is ohmically coupled to the first resonant element third section 340. The first resonant element third section 340 has a length of $L_h$ 304 and is substantially perpendicular to the first resonant element second section 342 and is substantially parallel to the first resonant element first section 332. The length $L_h$ 304 is 15 mm in the exemplary embodiment. The first resonant element first section 332, the first resonant element second section 342 and the first resonant element third section 340 of the first resonant element 352 form a substantially "J" shape that defines the element plane 116.

A second resonant element 350 consists of a second resonant element third section 334, a second resonant element second section 336 and a second resonant element first section 338. The second resonant element 350 of the exemplary embodiment is located in the element plane 116. The second resonant element third section 334 of the second resonant element 350 couples in a substantially perpendicular arrangement with the element connection arm 108, and is substantially parallel to the first resonant element first section 332, at a distance of $w_1$ 318 below the stubby element connection point 330. The distance $w_1$ 318 in the exemplary embodiment is 1.5 mm. The second resonant arm 350 couples to the element connection arm 108 at the end of the element connection arm 108 that is opposite the end coupling to the first resonant arm 352. The second resonant element second section 336 extends at an angle towards the first resonant element first section 332 and has a length of $L_6$ 308, which is 8 mm in the exemplary embodiment. The second resonant element 350 has a second resonant element first section 338 that is ohmically coupled to and extends from the end of the second resonant element second section 336 for a length of $L_p$ 310. The length $L_p$ 310 is 15 mm in the exemplary embodiment. The second resonant element first section 338 is arranged to be substantially parallel to the first resonant element first section 332 and the first resonant element third section 340 and is arranged to be positioned within the substantially "J" shape formed by the first resonant element. It is further to be noted that the second element third section 340 is in ohmic contact with the element connection arm 108 through the second element second section 336 and the second element third section 334. The second resonant element third section 338 is located at a distance $w_4$ 312 above the first resonant element third section 340. The distance $w_4$ 312 is 2 mm in the exemplary embodiment.

The PC-FJA 104 allows frequency resonance tuning for each of its multiple RF bands by adjustment of almost independent tuning parameters. Tuning of the exemplary embodiment of the present invention includes almost independent adjustment of four resonance frequencies. A first resonant frequency, the lowest radio frequency band in which the PC-FJA 104 efficiently radiates and includes the 800 MHz and 900 MHz bands in the exemplary embodiment, is mainly controlled by the overall length L 314 of the PC-FJA 104. Extending the length L 314 lowers the lowest resonant frequency of the PC-FJA 104. In the exemplary embodiment of the exemplary cellular phone 100, the lowest resonant frequency is tuned to be higher under free-space conditions than that desired for operation. The exemplary cellular phone 100 compensates for this by loading the antenna with dielectric material to lower the lowest resonant frequency to the desired range. The antenna of the exemplary embodiment is installed into a plastic case 102 with a plastic antenna holder (not shown). These plastic parts provide dielectric loading to the PC-FJA 104 and lowers the resonant frequencies of the antenna, with the greatest dielectric loading affect occurring at the lower frequency bands.

A second resonant frequency, which includes the 1800 MHz and 1900 MHz bands in the exemplary embodiment, is primarily affected by the length $L_p$ 310 of the second resonant element first section 338. Decreasing the length $L_p$ 310 increases the second resonant frequency of the PC-FJA 104.

A third resonant frequency, which includes the 2400 MHz band used by Bluetooth® communications and the IEEE 802.11b/g standards, is adjusted by changing the length $L_w$ of the third resonance arm 118. It is to be noted that the operation of the PC-FJA 104 creates this third resonant frequency by electromagnetic coupling of the third resonance arm 118 with other elements, in particular the second resonant element first section 338 and the first resonant element third section 340.

The fourth resonant frequency, which includes the 5200 MHz band used by the IEEE 802.11a standard, is adjusted by changing the length Ls 202 of the short loop 132. Increasing the length Ls 202 decreases the fourth resonant frequency.

The stubby element 130 is located in the exemplary embodiment so as to be at a low impedance point of other elements of the PC-FJA 104, including the first resonant element 352. Placement of the stubby element 130 at a low impedance point in this context refers to placing the stubby element 130 at a point proximate to a region of low current distribution along the other antenna elements. For example, placing the stubby element 130 at a low impedance point of the "J" shaped first resonant element 352 minimizes disturbance of the electromagnetic field created by the first resonant element 352 and thereby minimizes any affects on the resonant frequency of the first resonant element 352. Placing the stubby element 130 at a low impedance point of the other antenna elements allows independent tuning of the fourth resonant frequency of the exemplary embodiment by adjustment of the length Ls 202 without affecting other resonant frequencies of the PC-FJA 104.

The third resonant element 118 of the exemplary embodiment is located at a low impedance point of the first resonant element 152. This placement minimizes changes to the first resonant frequency and the second resonant frequency by the introduction of the third resonant element 118. The third resonant frequency is, however, a product of close electromagnetic coupling, in the frequency band in the vicinity of the third resonant frequency, between the third resonant element 118 and the second resonant element first section 338, the first resonant element 352, and second resonant element second section 336.

The dimensions described above for the exemplary embodiment of the present invention are based upon a lowest resonant frequency of 1100 MHz. This lowest resonant frequency is chosen because expected dielectric loading from the plastic case 102, plastic antenna holder (not shown) and other effects are expected to lower this lowest resonant frequency into the 800/900 MHz radio frequency band. As is understood by ordinary practitioners in the relevant arts in view of the present disclosure, the antenna of the exemplary embodiment is able to be scaled to operate at other resonant frequencies. The dimensions specified above are based upon the 1100 MHz base frequency of this design. The above described dimensions are able to be readily scaled to design an antenna with any desired base frequency.

The performance of the PC-FJA 104 has been noticed to be improved when the PC-FJA 104 is not facing a metal plate, such as a printed circuit board.

Figure 4:
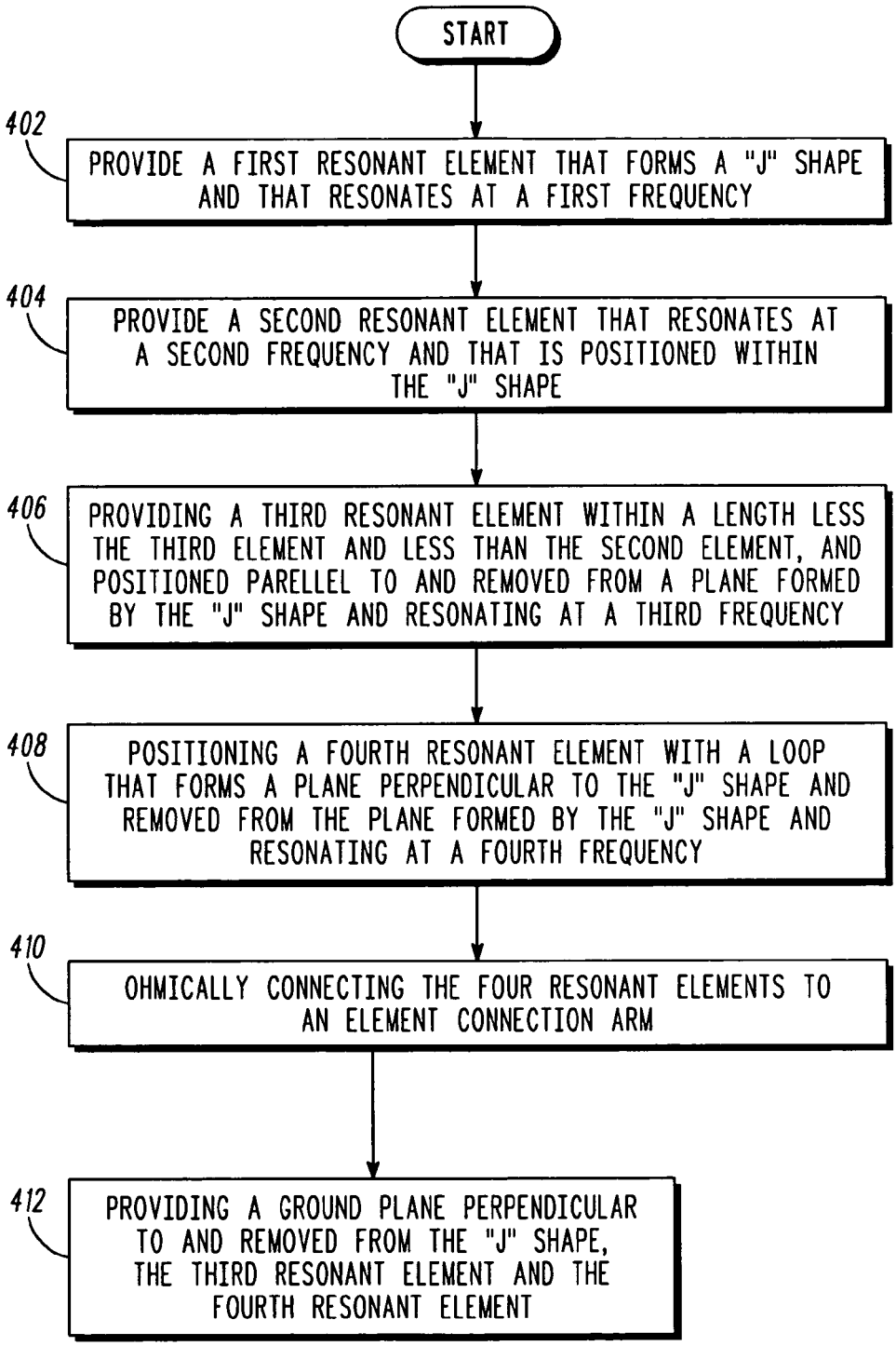
FIG. 4 illustrates a processing flow diagram as performed by an exemplary embodiment of the present invention.

FIG. 4 illustrates a processing flow diagram 400 as performed by an exemplary embodiment of the present invention. The processing flow begins by providing, at step 402, a first resonant element 352 that forms a "J" shape defining an element plane and configured to electrically resonate at a first radio frequency. The method continues by providing, at step 404, a second resonant element 350 that has at least a second resonant element first section 338. The second resonant element 350 is configured to electrically resonate at a second radio frequency that is higher than the first radio frequency. The second resonant element first section 338 is positioned within the "J" shape. The method then provides, at step 406, a third resonant element 118 with at least a portion that is substantially parallel to and removed from the element plane 116. The third resonant element 118 has a length less than the first resonant element and less than the second resonant element. The third resonant element 118 is configured to electrically resonate at a third radio frequency. The method also provides, at step 408, a fourth resonant element 130 that has a loop 132. At least a part of the fourth resonant element 130 defines a second plane perpendicular to the element plane 116. The positioning of the fourth resonant element 130 includes positioning the loop 132 so as to be removed from the element plane 116. The fourth resonant element 130 is configured to electrically resonate at a fourth radio frequency. The method then ohmically couples, at step 410, the first resonant element 352, the second resonant element 350, the third resonant element 118, and the fourth resonant element 130 to an element connection arm 108. The method then provides, at step 412, a ground plane perpendicular to and removed from the "J" shape, the third resonant element and the fourth resonant element. The processing then finishes.

Figure 5:
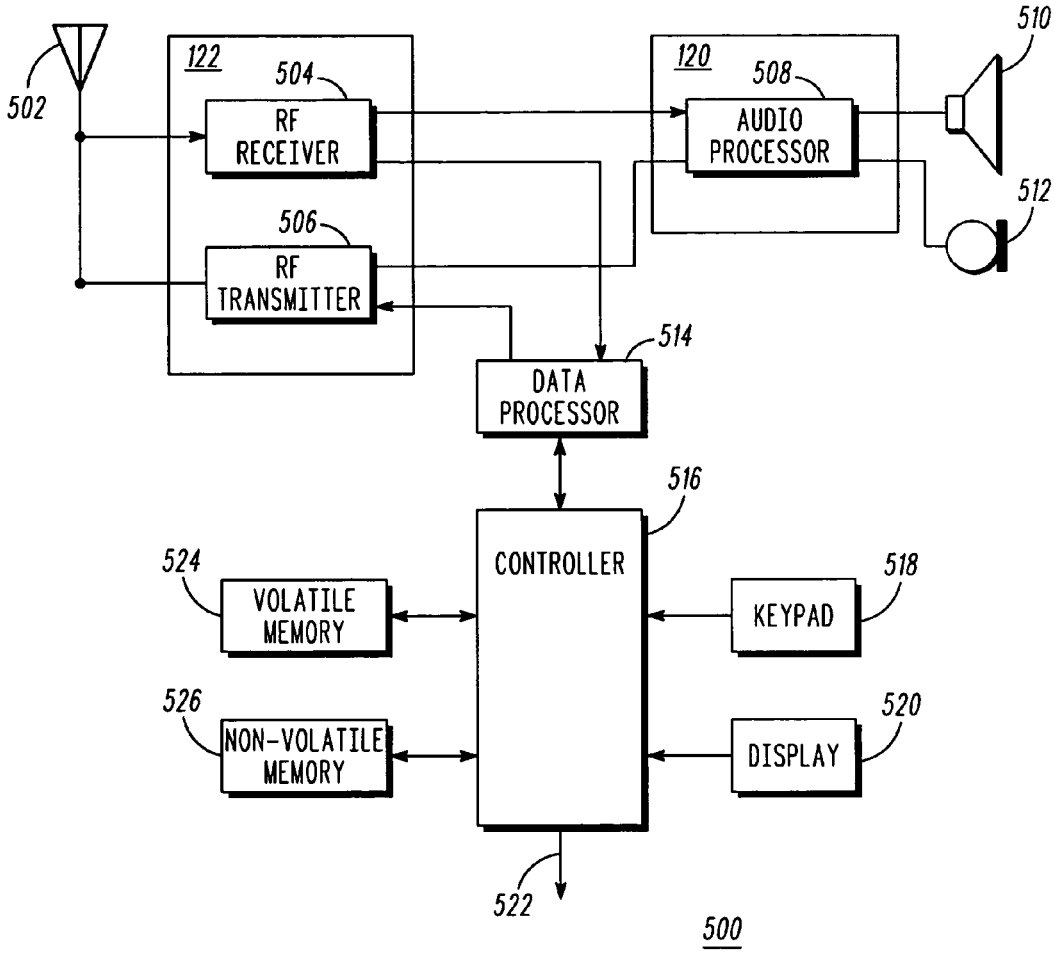
FIG. 5 illustrates a cellular phone block diagram according to an exemplary embodiment of the present invention.

FIG. 5 illustrates a cellular phone block diagram 500 according to an exemplary embodiment of the present invention. The cellular phone block diagram 500 illustrates the circuits included in a cellular phone, such as the exemplary cellular phone 100. The cellular phone block diagram 500 includes an RF antenna 502, a receiver 504 and RF transmitter 506. The RF transmitter 506 and RF receiver 504 are contained in the RF circuits 122 of the exemplary embodiment and are coupled to the RF antenna 502 in order to support bi-directional RF communications. The RF antenna 502 includes a PC-FJA 104 in the exemplary embodiment. The cellular phone 100 is able to simultaneously transmit and receive voice and/or data signals to and from a base station (not shown). The RF receiver 504 provides voice data to an audio processor 508 (in the baseband circuit 120), and the audio processor 508 provides voice data to the RF transmitter 506 to implement voice communications. The audio processor 508 obtains voice signals from microphone 510 and provides voice signals to speaker 512. The RF receiver 504, RF transmitter 506, Audio processor 508, microphone 510 and speaker 512 operate to communicate voice signals to and from the exemplary cellular phone 100 in manners similar to those used by conventional cellular phone.

The cellular phone block diagram 500 includes a controller 516 that controls the operation of the cellular phone 100 in the exemplary embodiment. Controller 516 is coupled to the various components of the cellular phone block diagram 500 via control bus 522. Controller 516 also communicates data to external devices, such as a base station and/or a server, through a wireless link (not shown). Controller 516 provides data to and accepts data from data processor 514. Data processor 514 of the exemplary embodiment performs communications processing necessary to implement over-the-air data communications to and from external stations. Data processor 514 provides data for transmission to the RF transmitter 506 and accepts received data from RF receiver 504.

Controller 516 provides visual display data to the user through display 520. Display 520 of the exemplary embodiment is a Liquid Crystal Display that is able to display alphanumeric and graphical data. Controller 514 also accepts user input from keypad 518. Keypad 518 is similar to a conventional cellular phone keypad and has buttons to accept user input in order to support operation of the exemplary embodiment of the present invention.

Controller 516 of the exemplary embodiment stores and retrieves data from volatile memory 524 and non-volatile memory 526. Non-volatile memory 526 includes computer program products and other data that changes infrequently to support operation of the cellular phone 100. Although non-volatile memory 526 contains data that does not routinely change during the operation of cellular phone 100, the contents of the non-volatile memory 526 are able to be changed when reprogramming is desired. Non-volatile memory 526 is able to consist of Electrically Erasable Programmable Read-Only Memory (EEPROM) and other such devices known to ordinary practitioners in the relevant arts. Volatile memory 525 stores data that can change during normal operation of the cellular phone 100, and consists of Random Access Memory (RAM) in the exemplary embodiment.

The exemplary embodiments of the present invention advantageously provide a compact antenna structure that supports operation in four radio frequency bands that are required by six independent radio frequency communications standards.

Figure 6:
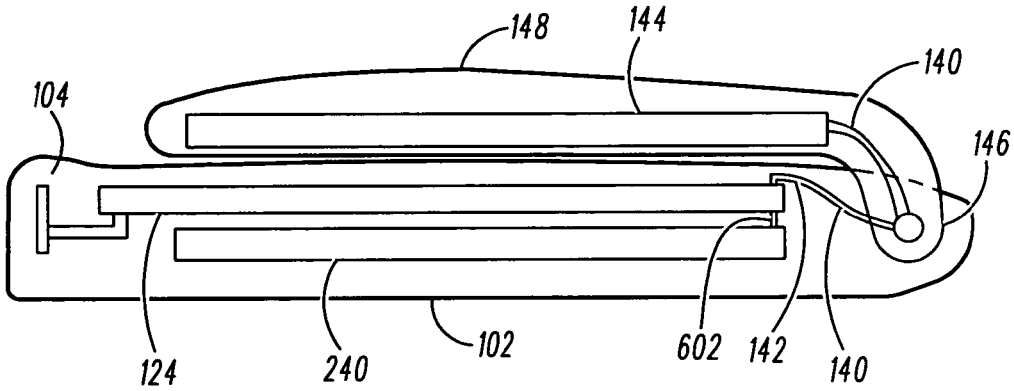
FIG. 6 illustrates a cellular telephone with folded flip portion, according to an exemplary embodiment of the present invention.

FIG. 6 illustrates a cellular telephone with folded flip portion 600, according to an exemplary embodiment of the present invention. The cellular phone with folded flip portion 600 illustrates a cut-away profile of a cellular phone case 102 with an electronic circuit board 124 and circuit board ground plane 240. The circuit board ground plane 240 is shown to be coupled to a ground circuit on the electronic circuit board 124 by a ground post 602. Further embodiments of the present invention incorporate ground planes that are part of or attached to case 102 or that are an area of printed circuit conductor that is physically part of the electronic circuit board 124. The flip portion 148 includes the second ground plane 144 that is coupled through a ground cable 140 to a ground connection 140 on the electronic circuit board 124 as is the circuit board ground plane 240. The circuit board ground plane and the second ground plane 144 are electrically coupled in the exemplary embodiment through the ground circuit on the electronic circuit board 124. The ground cable routes through hinge 146 in the exemplary embodiment. It is to be noted that the second ground plane 144, even when the flip portion 148 is placed in its folded position, is removed from the PC-FJA 104 so that the second ground plane 144, and in fact no metallization of the flip portion 148, overlaps any portion of the PC-FJA 104.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments, and it is intended that the appended claims cover any and all such applications, modifications, and embodiments within the scope of the present invention.

What is claimed is:

1. An antenna, comprising:

a ground plane;

a first resonant element resonating at a first frequency forming a substantially "J" shape defining an element plane substantially perpendicular to and removed from the ground plane;

a second resonant element electrically resonating at a second frequency that is higher than the first frequency and comprising at least a second resonant element first section positioned within the "J" shape;

a third resonant element having a length less than the first resonant element and less than the second resonant element, positioned at a low impedance point of the first resonant element and configured to electrically resonate at a third frequency with at least a portion substantially parallel to and removed from the element plane and removed from the ground plane;

a fourth resonant element resonating at a fourth frequency and comprising a loop defining a second plane perpendicular to the element plane, the loop being removed from the element plane and the ground plane, the loop positioned at a low impedance point of the first resonant element; and an element connection arm ohmically coupled to the first resonant element, the second resonant element, the third resonant element and the fourth resonant element.

2. The antenna of claim 1, wherein the second resonant element first section lies in the element plane.

3. The antenna of claim 1, wherein the fourth resonant element further comprises a first arm and a second arm, a first end of the loop being ohmically coupled by the first arm to the element connection arm, at least a portion of the second arm being ohmically coupled to an opposite end of the loop.

4. The antenna of claim 1, wherein the third resonant element and the fourth resonant element couple to the connection arm between a connection of the first resonant arm to the connection arm and a connection of the second resonant arm to the connection arm.

5. The antenna of claim 1, wherein the third resonant element further forms a bulge between the third resonant element and the element plane along at least a portion of the third resonant element.

6. The antenna of claim 1, wherein the loop comprises a loop first straight segment, a loop second straight segment and a loop third segment, the loop first straight segment and the loop second straight segment are substantially straight and arranged so as to be substantially parallel, aligned, and reactively coupled.

7. The antenna of claim 1, further comprising a ground plane substantially perpendicular to the element plane, and removed from the element plane, the third resonant element and the fourth resonant element.

8. The antenna of claim 1, wherein the first resonant element comprises a first resonant element first section, a first resonant element second section, and a first resonant element third section, a first end of the first resonant element first section being ohmically coupled to the element connection arm and an opposite end of the first resonant element first section being ohmically coupled to a first end of the first resonant element second section, the first resonant element second section being substantially perpendicular to the first resonant element first section, the first resonant element third section being coupled to an opposite end of the first resonant element second section, the first resonant element third section being substantially parallel to the first resonant element first section.

9. The antenna of claim 8, wherein the second resonant element first section is positioned between the first resonant element first section and the first resonant element third section, the second resonant element first section having a length less than the first resonant element first section.

10. The antenna of claim 1, wherein the second resonant element further comprises a second resonant element second section and a second resonant element third section, a first end of the second resonant element third section being ohmically coupled the element connection arm, an opposite end of the second resonant element third section being ohmically coupled to a first end of the second resonant element second section, an opposite end of the second resonant element second section being ohmically coupled to a first end of the second resonant element first section.

11. The antenna of claim 10, wherein the second resonant element third section is substantially parallel to at least one section of the first resonant element.

12. A method comprising:

providing a ground plane;

providing a first resonant element that forms a "J" shape, that is configured to electrically resonate at a first frequency, and that defines an element plane substantially perpendicular to and removed from the ground plane;

providing a second resonant element configured to electrically resonate at a second frequency higher than the first frequency, the second resonant element comprising at least a second resonant element first section that is positioned within the "J" shape;

providing a third resonant element with at least a portion substantially parallel to and removed from the element plane, the third resonant element being removed from the ground plane and having a length less than the first resonant element and less than the second resonant element, the third resonant element positioned at a low impedance point of the first resonant element and configured to electrically resonate at a third frequency;

providing a fourth resonant element comprising a loop with at least a part of the fourth resonant element defining a second plane perpendicular to the element plane and removed from the ground plane, the positioning of the fourth resonant element comprising positioning the loop so as to be removed from the element plane, the fourth resonant element positioned at a low impedance point of the first resonant element and configured to electrically resonate at a fourth frequency; and ohmically coupling the first resonant element, the second resonant element, the third resonant element and the fourth resonant element to an element connection arm.

13. The method according to claim 12, further comprising adjusting the first resonant frequency by adjusting a length of the first resonant element.

14. The method according to claim 12, further comprising adjusting the second resonant frequency by adjusting a length of the second resonant element.

15. The method according to claim 12, further comprising adjusting the third resonant frequency by adjusting a length of the third resonant element.

16. The method according to claim 12, further comprising adjusting the fourth resonant frequency by adjusting a length of the fourth resonant element.

17. A wireless communications device, comprising:

at least one of a receiver for wirelessly receiving transmitted signals and a transmitter for wirelessly transmitting signals;

a ground plane;

a first resonant element resonating at a first frequency forming a substantially "J" shape defining an element plane substantially perpendicular to and removed from the ground plane;

a second resonant element electrically resonating at a second frequency that is higher than the first frequency and comprising at least a second resonant element first section positioned within the "J" shape;

a third resonant element having a length less than the first resonant element and less than the second resonant element, positioned at a low impedance point of the first resonant element and configured to electrically resonate at a third frequency with at least a portion substantially parallel to and removed from the element plane and removed from the ground plane;

a fourth resonant element resonating at a fourth frequency and comprising a loop defining a second plane perpendicular to the element plane, the loop being removed from the element plane and the ground plane, the loop positioned at a low impedance point of the first resonant element; and an element connection arm ohmically coupled to the first resonant element, the second resonant element, the third resonant element and the fourth resonant element.

18. The wireless communications device of claim 17, further comprising cellular telephone communications circuits that comprise the least one of a receiver and a transmitter.

19. The wireless communications device of claim 17, further comprising data communications circuits that comprise the least one of a receiver and a transmitter.

20. The wireless communications device of claim 17, further comprising a case containing the first resonant element, the second resonant element, the third resonant element, the fourth resonant element and the element connection arm, and the at least one of a receiver and a transmitter, the case further containing a first ground plane substantially perpendicular to the element plane and removed from the element plane, the third resonant element and the fourth resonant element, the case further having a rotatably attached flip portion containing a second ground plane electrically coupled to the first ground plane, the flip portion able to be positioned into an extended position and a folded position, the second ground plane remaining removed from the element plane, the third resonant element and the fourth resonant element when the flip portion is in the folded position.

* * * * *